United States Patent [19]

Sakai et al.

[11] Patent Number: 4,491,831

[45] Date of Patent: Jan. 1, 1985

[54] METHOD AND APPARATUS FOR ANALYSIS OF INFORMATION ABOUT YARN EVENESS

[75] Inventors: Shojo Sakai, Kyoto; Hisaaki Kato; Yoshihiko Samoto, both of Shiga; Kenichi Inada, Kyoto, all of Japan

[73] Assignee: Murata Kikai Kabushiki Kaisha, Japan

[21] Appl. No.: 335,213

[22] Filed: Dec. 28, 1981

[30] Foreign Application Priority Data

Oct. 9, 1981 [JP] Japan ..... 56-161869

[51] Int. Cl.[3] ..... G08B 21/00

[52] U.S. Cl. ..... 340/677; 66/163; 139/370.1; 340/715

[58] Field of Search ..... 340/715, 677; 139/370.1, 370.2; 66/163

[56] References Cited

U.S. PATENT DOCUMENTS

| | | | |
|---|---|---|---|
| 3,594,755 | 7/1971 | Pijls | 340/677 X |
| 3,731,069 | 5/1973 | Goto et al. | 340/677 X |
| 4,007,457 | 2/1977 | Aeppli | 340/677 X |
| 4,183,381 | 1/1980 | Gotoh | 340/677 X |
| 4,184,769 | 1/1980 | Aeppli | 66/163 X |

*Primary Examiner*—David L. Trafton

*Attorney, Agent, or Firm*—Spensley Horn Jubas & Lubitz

[57] ABSTRACT

A yarn eveness detector in a textile machine generates an analog signal in response to yarn uneveness. The analog signal is digitized and subjected to real time processing in a computer for analysis of both cyclic and non-cyclic yarn irregularity. A signal may be generated in response to irregularities exceeding a certain value.

13 Claims, 8 Drawing Figures

METHOD AND APPARATUS FOR ANALYSIS OF INFORMATION ABOUT YARN EVENESS

BACKGROUND OF THE INVENTION

1. Field of the Invention

This invention relates to a method and apparatus for analyzing information about yarn eveness.

2. Description of the Prior Art

In the case of yarn spun on a spinning frame, an individual yarn imperfection such as slub sticking to the yarn is detected during the spinning operation by a slub catcher fixed to the spinning frame. However, defects such as variation in yarn thickness are not detected during said operation. Instead, pieces of full bobbins with wound-up yarn must be sampled. Strands of yarn on said bobbins are evaluated with respect to eveness by testing apparatus such as the Uster eveness tester or spectrograph, installed on a site other than that of the spinning frame, for the purpose of testing said yarn and estimating defects in the spinning frame that has spun said yarn.

Variation in thickness of yarn is categorized into two kinds: (1) cyclic variation, caused by defects such as eccentricity or deformation of a roller or by defects in the driving system, or (2) non-cyclic variation, caused by worn-out aprons, etc. Cyclic variations produce defects such as moire patterns appearing on the woven fabric, extremely degrading the commercial value of the fabric.

So far as detection of yarn eveness depends on such methods as above, many hands are required for sampling and, further, a long period of time is required for testing by means of the Uster tester and spectrograph. Test results are low in accuracy and, even when a final analysis result is reliable, the spinning frame has been continuously driven without removal of the defect during performance of the analysis. A large quantity of imperfect irregular yarn is therefore produced under these prior art testing methods.

Said prior art testing methods are not only troublesome because of the many steps required, but are also substantially impossible to apply to a multiplicity of spindles at short intervals. This fact accounts for an increase in the risk of overlooking the production of defective yarn by using these prior art testing materials.

An objective of the present invention is to provide a yarn defect detector which detects and analyzes yarn defects as quickly as possible, so that the defective part in the spinning frame which causes the yarn defect may be detected and corrected as early as possible. A further objective is to provide such detection virtually simulataneously on a multitude of spindles.

SUMMARY OF THE INVENTION

In accordance with the present invention, these and other objectives are achieved by providing an analog signal emitted from the yarn eveness detector directly fixed to the textile machine. The analog signal is digitized and then subjected to real time or near real time processing in a computer for analysis of the yarn irregularity with high precision in a very short period of time, thereby enabling a fully automatic detection system for yarn irregularity on a multiplicity of spindles.

DESCRIPTION OF THE PREFERRED EMBODIMENT

The following detailed description is of the best presently contemplated mode of carrying out the invention. This description and references to the specific electronic components used in the preferred embodiment are not to be taken in a limiting sense, they are made merely for the purpose of illustrating the general principles of the invention since the scope of the invention is best defined by the appended claims.

Although this invention is applicable to all kinds of fine spinning frames and those textile machines which have at least one opening for feeding yarn, it will be described hereunder with reference to an example applied to an air spinning frame.

Figure 1:
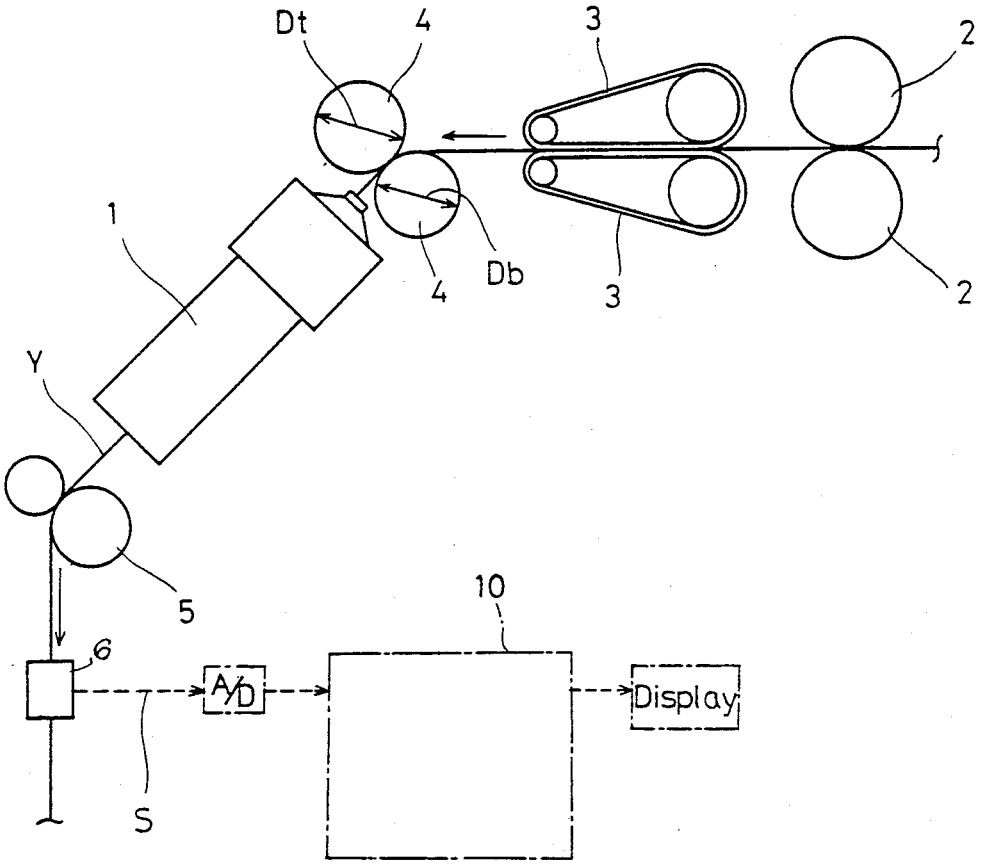
FIG. 1 is a schematic view of a drafting part and a nozzle part of a spinning frame provided with an analysis apparatus according to the present invention.

In FIG. 1, the reference numeral 1 designates a nozzle for applying twists to the sliver drafted by pairs of back rollers 2, aprons 3, and front rollers 4. Spun yarn Y, after having been passed through this nozzle 1, is wound around a bobbin (not shown) through the delivery rollers 5. Subsequent to said delivery rollers 5 is a slub catcher 6 (Nihon Selen Co. NC-67 BA) consisting of a light emitting diode 7 and a phototransistor 8 as shown in detail in FIG. 2. In this embodiment, electric analog signal S (FIG. 4) emitted from said slub catcher 6 is used for analysis of yarn irregularity.

Figure 3:
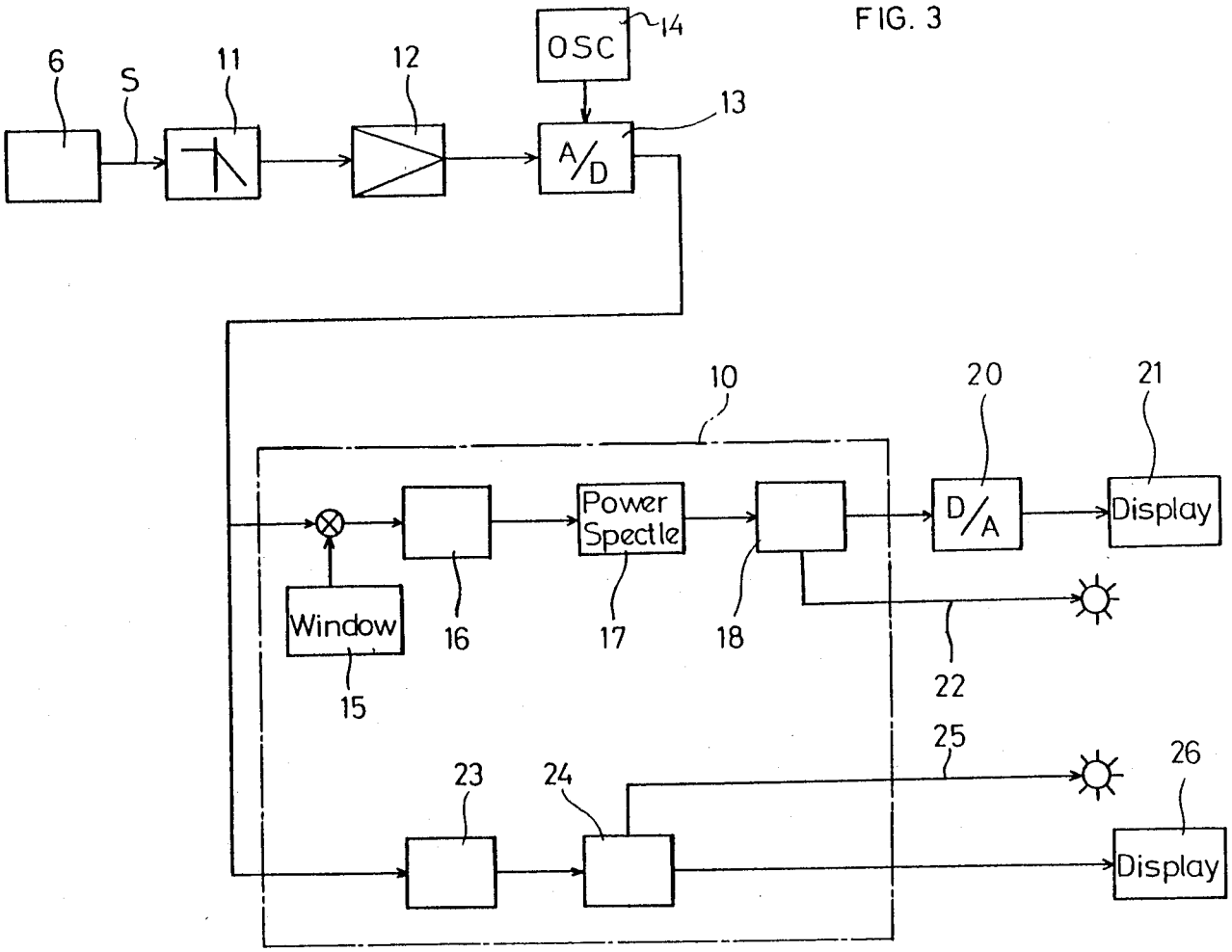
FIG. 3 is a block diagram showing an analysis apparatus according to the present invention.

Slub catcher 6 is a detector of high sensitivity and high response capability in which the quantity of light emitted from the light emitting diode 7 is detected by the phototransistor 8 and then translated into an electrical signal S. When an extremely large yarn defect is detected, a yarn cutting means (not shown) is operated to cut the defective part of the yarn Y. Electric signal S from the slub catcher/detector 6 is inputted into the computer 10 for analysis, after being digitized in the following manner:

As shown in FIG. 3, electric analog signal S is passed through the low-pass filter 11 (−60 dB/OCT) for smoothing of the signal and for prevention of aliasing, or insufficient sampling of analog data by inadequate cut-off frequency of low pass filter. (The low-pass filter should be used to prevent aliasing by the Nyquist standard.) The output of low-pass filter 11 is then amplified to an electric voltage level appropriate for A/D coversion by the amplifier 12 (a gain of 50 is used in the preferred embodiment), and converted into a digital signal by the A/D converter 13 (Micro Networks Co. ADC 80 AG). This A/D converter 13 performs sampling of input signals for digitizing by means of an oscillator 14 which operates for setting a data sampling time specified according to the frequency band width to be analyzed in accordance with well known teachings in the prior art. The frequency band width to be analyzed is approximately 0–50 Hz for a yarn being spun at a rate of approximately 150 m/min.

The signal thus digitized is inputted into the computer 10 and, in the case of this embodiment, subjected to spectrum analysis and integral analysis.

Describing spectrum analysis first, a signal from the A/D converter 13 is given a weight by the window 15 (HITACHI P-ROM HN462716) and transmitted to the Fourier transformer 16 (TRW LSI Ind. TDC-1009J) for computation. The computation result is vector-synthesized into a power spectrum by 17 (Nippon Electric in PD8085 AC/D) to be put out as a power spectrum of all frequency components.

Figure 5:
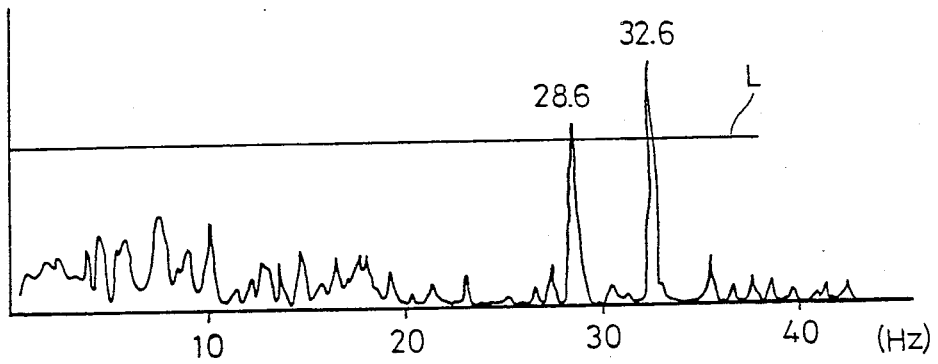
FIG. 5 is a view showing an example of the spectrum signal generated after the electric signal emitted from the yarn eveness detector is subjected to analysis.

The signal put out as a power spectrum of all frequency components is processed by the output processing circuit 18 (Nippon Electric CPU uPD8085 AC/D) to be suitable for analysis in such a way that a signal exceeding a fixed frequency value (for example, 50 Hz), is cut. (Analysis of frequencies greater than 50 Hz is not required to find uneveness in yarn travelling at a speed of about 150 m/min.) During processing, the amplitude of the power spectrum may be raised or lowered. The processed signal is inputted into the D/A converter 20 (Nippon Electric Analog Devices uPC159A AD7533) from the computer 10 and converted into an analog signal which may be displayed graphically as in the display 21 (Iwasaki Tsushiuki XY-6002) (FIG. 5). This spectrum graph shown in the display 21 enables interpretation of cyclic yarn irregularity. The numeral 22 represents an alarm circuit (Nippon Electric uuPD8255 AC-5) that will be described later. The collection and processing of this data to obtain the information shown in FIG. 5 requires about forty seconds of real time.

Figure 6:
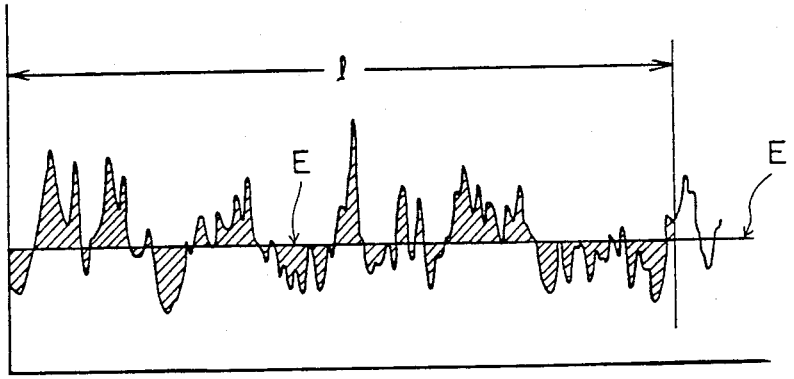
FIG. 6 is a view showing the principle of integral analysis of the electric signal emitted from the yarn eveness detector.

In integral analysis, the yarn irregularity signal digitized by the A/D converter 13 is transmitted to the integrator 23 (Nippon Electric uPD8085 AC/D) after being inputted into the computer 10. As illustrated in FIG. 6, in integrator 23 the absolute value of displacement from a fixed value E is integrated with respect to a certain interval 1 (a yarn length along which yarn eveness is observed, typically about 25 m). The value of E is determined empirically for each type of yarn. The integrated value may be considered the U% relative to E, where U is the Uster irregularity measurement number well known in the textile industry.

The integrated value is transmitted to the output processing circuit 24 which, in the preferred embodiment, includes Nippon Electric CPU uPD8085 AC/D. Said circuit 24 performs processing of, for example, counting fractions of 5 and over as a unit and disregarding the rest for equalizing units of figures, or emitting signal to the alarm circuit 25 upon judging said value to be in excess of a fixed value; and then digitally indicated in numeric values as it is in the digital display 26. In the preferred embodiment, alarm circuit 25 consists of Nippon Electric uPD8255 AC-5 and digital display 26 consists of Iwasaki Tsushinki XY-6002. The reading of digital display 26 is representative of the standard deviation from the mean value E. The collection and processing of the data to obtain the information displayed in display 26 requires about sixty-one seconds of real time.

Figure 2:
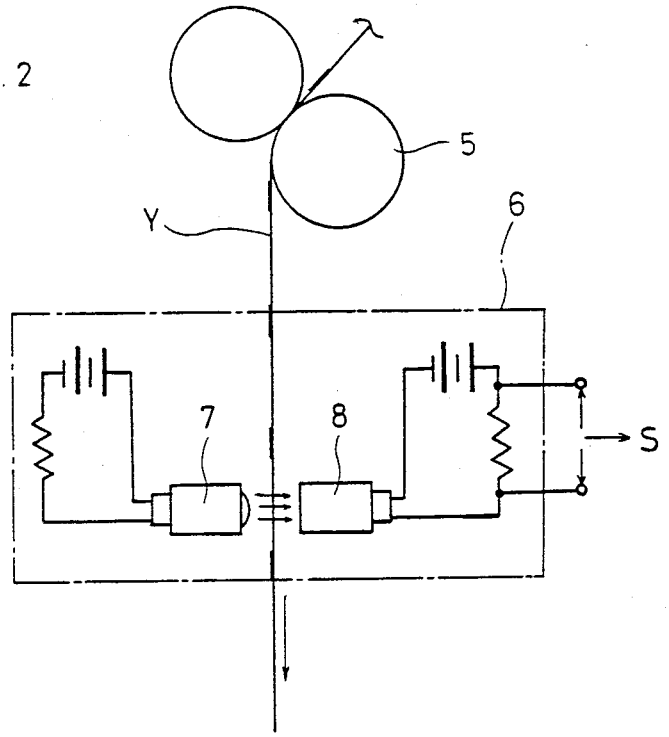
FIG. 2 is a schematic diagram of a circuit showing the compositional arrangement in the yarn eveness detector of the present invention.
Figure 4:
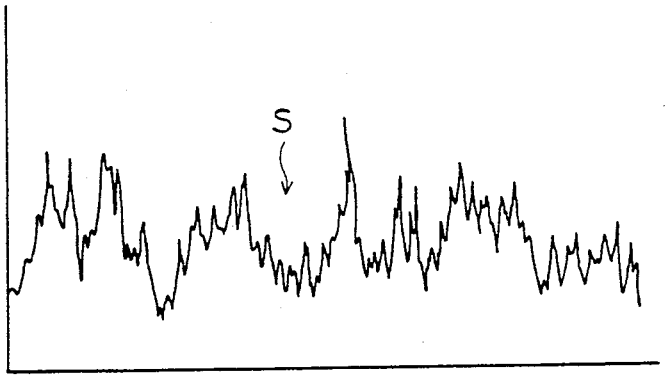
FIG. 4 is a view showing an example of an electric signal emitted from the yarn eveness detector of the present invention.

On the assumption that the yarn Y having cyclic irregularity as exaggeratingly shown in FIG. 2 is spun at the speed of 152 meters/minute and the detector 6 detects this irregularity and emits an electric signal S as shown in FIG. 4, said signal S is digitized in such manner as described above, subjected to real time processing by the computer 10, and indicated as spectrum graph and integral value of the displays 21 and 26, respectively. By interpreting these indications in the manner described below, a methematical test of the yarn and estimation of defective part in said spinning frame is made possible.

In FIG. 5, for example, from two peaks observed at frequency values of 28.6 and 32.6 Hz, it can be presumed that this uneveness was caused by the front and the bottom front rollers by reason of the known fact that the cycle $\lambda t$ due to the front top roller is equal to 32.3 r.p.s. [calculated as $(152\times100/60)\div(2.5\times\pi)$] as well as the cycle $\lambda B$ due to the front bottom roller is 28.8 r.p.s. [$(152\times100/60)\div(2.8\times\pi)$, where yarn speed is 152 m/min, front top roller diameter $D_t$ is 28 mm, and front bottom roller diameter $D_b$ is 25 mm].

When a peak appears in other values of frequency, yarn irregularities are traceable to defects in other rollers or driving system and the causes thereof can be estimated in the same way as above.

From the integrated value indicated in the display 26, variation in yarn thickness within a fixed interval 1 can be observed, for example, if measurement was performed in the above case, the total sum of variation in the yarn length of 152 m is obtained. Assuming that said total sum amounts to 250 U% and exceeds a range of variation which is known to be desirable (for example, 50 to 200 U%), it has been discovered that it is highly probable that the worn surface of the apron accounts for this high degree of irregularity.

Estimation of yarn irregularity such as shown indicated in the displays 21 and 26 may be performed by the operator, or may depend on an automation arrangement in which the stop signal for the spinning frame and alarm signal 22 are emitted and indicated in the display 21 when the amplitude of a certain component of the spectrum exceeds a fixed level L in said output processors 18 and 24. Similarly, a stop signal for the each spinning frame and alarm signal 25 are emitted and indicated in the display 26 as well, when an integrated value exceeds a fixed level.

Those defects which have been detected in this way in the spinning frame are promptly corrected by removing rollers therefrom and a favorable condition may be restored quickly.

Since the method and apparatus for analysis according to this invention digitizes the analog signal emitted from the yarn eveness detector and puts it under real time or near real time processing as described above, it requires only a short length of time for analysis (on the order of a mili-second for calculation in practice), as compared to the processing of analog signals without conversion. The period of time required for analysis of yarn eveness information in this invention is approximately equal to that required for passing of a fixed length of yarn to be measured through the yarn eveness detector, that is, the time required for data sampling. Also, the accuracy in analysis is remarkably higher than that in analog processing. For example, the distinction between approximate values of frequency of cyclic irregularities caused by the top and the bottom rollers that are almost the same in diameter, which has been absolutely impossible in analog analysis, can easily be attained by said digitizing process. Thus, prompt detection of the defective yarn is made possible and details of the defect can be observed with high accuracy, thereby enabling exact estimation of the defective part in the spinning frame as a cause of said yarn defect. The digitized signal of yarn irregularity is also advantageous in that it is more easily processed with higher precision than the analog signal in the case of a comparison with set levels in the output process subsequent to the computation process.

According to this invention, since yarn eveness analysis requires only a short length of time, successive supervision of yarn eveness on a multiplicity of spindles by the use of a single computer 10 is made possible. Because of the short period of time required for every performance of analysis, and because damage to the roller or wear of the apron do not occur so frequently, yarn irregularities with respect to one spindle may be inspected at short, regular intervals, which enables adequate supervision on a large number of spindles by providing a small number of apparatus according to this invention.

Figure 7:
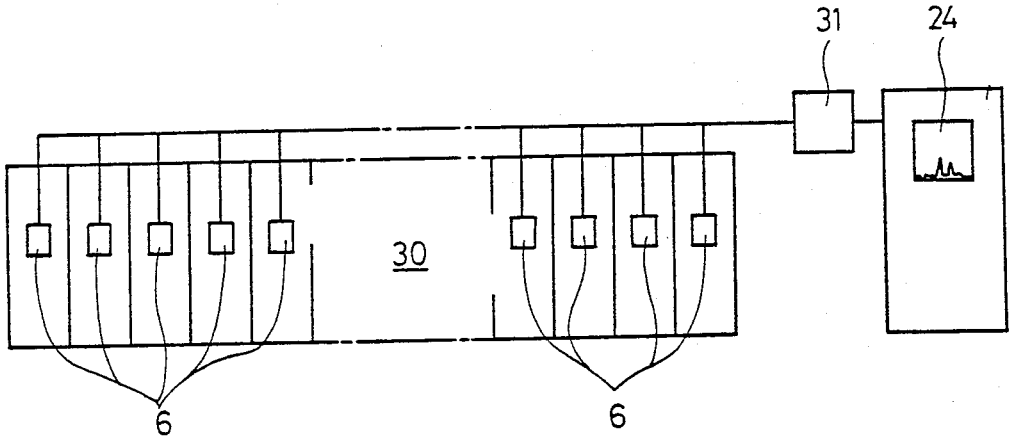
FIG. 7 is a schematic view of an embodiment in which an analysis apparatus according to the present invention is applied to a multiplicity of spindles on the spinning frame.
Figure 8:
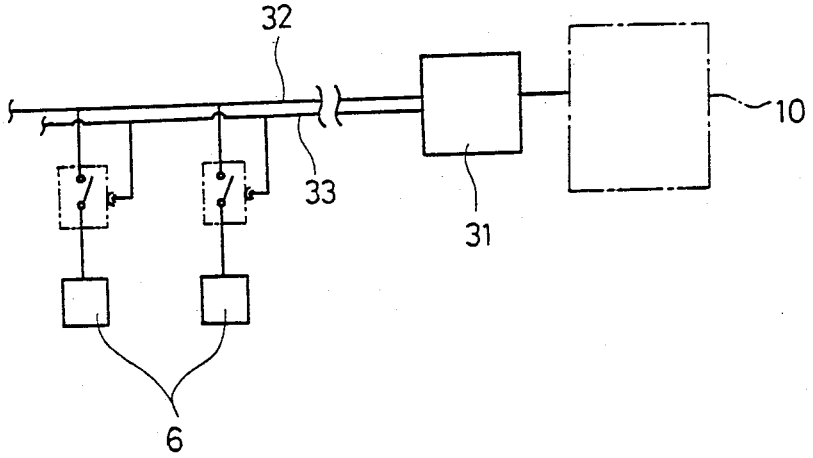
FIG. 8 is a schematic circuit diagram showing in detail a part thereof.

FIGS. 7 and 8 show a combination arrangement of yarn eveness detectors 6 fixed to all spindles of the spinning frame 30 connected to computer 10 and a multiplexer 31 of known design that connects said detectors to said computer. Said multiplexer 31 is adapted to electrically connect the spinning frame 30 with the computer 10 at each spindle only during a short fixed period of time. For example, on the assumption that there are 60 spindles and the time for measurement is 60 seconds per spindle, yarn eveness analysis is repeatedly performed once every hour at every spindle.

The reference numerals 32 and 33 indicate a wire for yarn eveness signal and a wire for control signal, respectively.

The time interval for measurement can be shortened according to the yarn speed and the length of yarn to be measured, and further shortened when the number of spindles to be measured is small.

By connecting a computer 10 after the A/D converter 13, this analysis may be processed by the computer 10 using a Fourier analysis program of a kind well known in the art. A device known as a TDC-1009J made by TRW LSI Products, replacing the Fourier analysis program, may accelerate the computing speed about 10 times.

What is claimed is:

1. A device for the real time analysis of the uneveness of yarn being fed through a textile machine comprising:

detection means for observing said yarn and producing a signal in response to the degree of uneveness of said yarn being fed through said machine;

first analysis means, connected to said detection means, for interpreting said signal and generating information identifying yarn uneveness which is cyclic in nature which may be used to identify the component of said textile machine that is causing said yarn uneveness; and second analysis means, connected to said detection means, interpreting said signal and generating information identifying yarn uneveness which is non-cyclic in nature which may be used as a comparison of the uneveness of the yarn being fed through said machine against a known irregularity standard.

2. A device as claimed in claim 1, further comprising:

first display means, connected to said first analysis means, for visually displaying the results produced by said first analysis means; and second display means, connected to said second analysis means, for visually displaying the information generated by said second analysis means.

3. A device as claimed in claim 2, wherein said first display means is an element presenting a two-dimensional image of the amplitude of cyclic yarn uneveness as a function of the frequency at which said cyclic yarn uneveness occurs, a differing frequency being directly relatable to each component of said textile machine.

4. A device as claimed in claim 2, wherein said second display means is an element presenting a numeric value indicating a measure by which said non-cyclic yarn uneveness differs from a known standard input thereto as a reference signal.

5. A device as claimed in claim 1 further comprising:

first response means, connected to said first analysis means, for generating a response signal when the signal generated by said first analysis means exceeds a first reference signal.

6. A device as claimed in claim 1 further comprising:

second response means, connected to said second analysis means, for generating a response signal when the signal generated by said second analysis means exceeds a certain second reference signal.

7. A device as claimed in claim 1 further comprising:

a multitude of signal detection means; and multiplexer means for periodically sampling the signals generated by said multitude of detection means and inputting said sampled signals into said analysis means;

whereby a multitude of yarns may be analyzed simultaneously.

8. A process for the real time analysis of the uneveness of yarn running through a textile machine comprising the steps of:

detecting said uneveness in said yarn;

generating a signal in response to said detected uneveness;

simultaneously analyzing said signal, in real time, for cyclic characteristics and for non-cyclic characteristics; and generating and displaying, concurrently, information based upon said cyclic characteristics to identify the component of said textile machine causing said yarn uneveness and information based upon said non-cyclic characterstics to provide a comparison of said yarn uneveness with a known standard of yarn irregularity.

9. A device for the real time analysis of the uneveness of yarn running through a textile machine comprising:

means for continuously detecting a characteristic of said running yarn, which characteristic is relatable to the thickness of said running yarn;

means for generating signals in response to variations in said continuously detected characteristic;

a low pass filter having said signals coupled thereto as an input, and providing output signals limited in frequency to the upper frequency of said filter;

means, accepting said filtered signals, for amplifying and digitizing said signals;

first real time analysis means, operating on said digitized filtered signals, for producing a Fourier transformed power spectrum of said signals, and for then comparing said power spectrum to a predetermined fixed threshold power value;

digital-to-analog converter means for converting said digital power spectrum, as it exceeds said threshold, into analog signals;

first display means for displaying said analog signals as a function of frequency;

second real time analysis means, operating on said digitized, filtered signals concurrently with said first real time analysis means, for producing an integrated summation of said digitized signals, said integration being performed with respect to a signal corresponding to a known standard of yarn irregularity input thereto as a reference; and second display means for displaying a numeric value corresponding to said integrated summation as compared with said reference;

whereby said frequencies displayed by said first display means are uniquely relatable to faulty components of said textile machine and said numeric value provides a measure of yarn quality.

10. A device as claimed in claim 9, further comprising:

first indicator means, coupled to the output of said first real time analysis means, for indicating the existence of at least one frequency of said power spectrum having an amplitude exceeding said threshold value; and second indicator means, coupled to the output of said second real time analysis means, for indicating that said integrated summation has exceeded said reference by a predetermined value;

said first and second indicator means being activated whenever their respective criteria have been satisfied.

11. A device as claimed in claim 9 wherein said low pass filter substantially passes all frequencies up to 50 Hertz and substantially does not pass frequencies above 50 Hertz.

12. A device as claimed in claim 9, wherein said standard of yarn irregularity is the Ulster irregularity measurement number, which number is appropriately scaled to provide an appropriate electrical reference signal.

13. A process for the real time analysis of the uneveness of yarn running through a textile machine comprising the steps of:

continuously sensing a characterstic of said yarn, which characteristic is relatable to its thickness;

continuously generating a signal in response to said sensed characteristic;

filtering said signal to exclude all frequencies in excess of a given low frequency;

digitizing said filtered signal;

forming, in real time, a Fourier transformed power spectrum of said digitized filtered signal;

truncating said power spectrum by a fixed threshold value;

displaying said truncated power spectrum such that all frequencies having power in excess of said fixed threshold are displayed;

using said displayed frequencies to identify those components of said textile machine which are inducing yarn uneveness;

continuously integrating, in real time, over a fixed time period, said digitized filtered signal concurrently with formation of said power spectrum;

comparing the resulting value of said integration at the end of said fixed time period, with a reference signal corresponding to a known measure of yarn irregularity; and concurrently displaying the result of said comparison as a numeric value relatable to yarn eveness quality.

* * * * *